US012789945B1

(12) United States Patent
Grueber

(10) Patent No.: US 12,789,945 B1
(45) Date of Patent: Nov. 10, 2026

(54) ELECTRIC BOAT WITH MODULAR CONSTRUCTION AND RELATED HULL FORM

(71) Applicant: Correct Craft IP Holdings, LLC, Orlando, FL (US)

(72) Inventor: Christopher Grueber, Athens, TN (US)

(73) Assignee: Correct Craft IP Holdings, LLC, Orlando, FL (US)

( * ) Notice: Subject to any disclaimer, the term of this patent is extended or adjusted under 35 U.S.C. 154(b) by 837 days.

(21) Appl. No.: 18/153,087

(22) Filed: Jan. 11, 2023

Related U.S. Application Data

(60) Provisional application No. 63/298,323, filed on Jan. 11, 2022.

(51) Int. Cl.

| | |
|---|---|
| ***B63B 3/08*** | (2006.01) |
| ***B63B 1/20*** | (2006.01) |
| ***B63H 21/17*** | (2006.01) |
| ***B63H 21/30*** | (2006.01) |

(52) U.S. Cl.
CPC ..... *B63B 1/20* (2013.01); *B63B 3/08* (2013.01); *B63B 2001/201* (2013.01); *B63H 21/17* (2013.01); *B63H 2021/307* (2013.01)

(58) Field of Classification Search
CPC ..... B63B 1/20; B63B 3/08; B63B 2001/201; B63H 21/17; B63H 2021/307
See application file for complete search history.

(56) References Cited

U.S. PATENT DOCUMENTS

| | | | | |
|---|---|---|---|---|
| 3,996,869 | A * | 12/1976 | Hadley | B63B 1/042 114/291 |
| 6,880,856 | B2 * | 4/2005 | Chernoff | B62D 65/04 280/781 |
| 11,167,832 | B2 * | 11/2021 | Doremus | B63B 1/10 |
| 11,643,176 | B1 * | 5/2023 | Mueller | B63B 35/38 440/1 |

* cited by examiner

*Primary Examiner* — Anthony D Wiest
(74) *Attorney, Agent, or Firm* — Allen, Dyer, Doppelt + Gilchrist, PA

(57) ABSTRACT

An electric boat features modular construction with a hull assembly carrying a battery, electric drive and steering actuator is mated with a superstructure assembly having a controller and user interface. All hull module electrical components are mated to the superstructure assembly via a disconnect. The hull module is configured with a central section containing the battery and drive components and sealed side modules.

22 Claims, 5 Drawing Sheets

ELECTRIC BOAT WITH MODULAR CONSTRUCTION AND RELATED HULL FORM

CROSS-REFERENCE TO RELATED APPLICATION

This application claims the benefit of U.S. Provisional Patent Application Ser. No. 63/298,323, filed on Jan. 11, 2022, the contents of which are herein incorporated by reference in their entirety.

FIELD OF THE INVENTION

The present invention relates to boats with electric drives, and more particularly, to the mating of boat hull and superstructure assemblies.

BACKGROUND OF THE INVENTION

Even relatively simple modern powerboats, like automobiles, involve a complex integration of power, mechanical and electrical systems, with corresponding lines, conduit and the like that must be run between hull and superstructure. The resulting boat must possess sufficient strength and stability to tolerate the multi-dimensional movements and stresses of a marine environment. Consequently, once boats start getting much larger than a dinghy, the boat design process tends to envision the finished product as a largely unified whole.

The improvement in battery technology and subsequent growth of electric propulsion for larger vehicles has allowed, in the automotive industry, a modular approach to vehicle design in which the major powertrain and control components are all located in a standardized chassis which can be mated relatively simply to any number of different bodies. An example of this design approach can be found in U.S. Pat. No. 6,880,856, the contents of which are herein incorporated by reference in their entirety. It would be beneficial if a similar design approach could be applied to boats.

SUMMARY OF THE INVENTION

In view of the foregoing, it is an object of the present invention to provide an electric boat with modular construction and related hull form. According to an aspect of the present invention, a modular boat comprises a hull assembly mated with a superstructure assembly. The hull assembly includes a battery compartment holding at least one battery and carries at least one electric drive and at least one steering actuator. A controller and a user interface are carried by the superstructure and operable to control the at least one electric drive and the at least one steering actuator, and to provide battery information about the at least one battery. A disconnect between the hull assembly and superstructure assembly effects making and unmaking all connections between superstructure and the at least one electric drive, at least one steering assembly and at least one battery of the hull assembly.

According to an aspect of the present invention, aligned access openings are formed over the battery compartment in the hull and superstructure assemblies, allowing access thereinto while the hull and superstructure assemblies are mated.

According to another aspect of the present invention, the hull assembly includes a central section containing the battery compartment and outboard sections on opposite sides of the central section, the outboard sections being completely sealed.

According to a further aspect, the hull assembly includes at least one electric thruster, the at least one electric thruster being powered by the at least one battery at by a common direct current (DC) voltage with the at least one electric drive.

According to an additional aspect, bottoms of the outboard sections are lower than a bottom of the central section and each outboard section includes a chine extending along a length thereof and forming a transition from a bottom to a sidewall.

According to further aspects, a majority of each sidewall above the chine is approximately vertical. Splash reduction channels extend between each apex and an outer edge of the bow of each outboard section.

According to another aspect, a mated area between the hull and superstructure assemblies is approximately rectangular.

According to a method aspect, a method of making a modular boat assembly comprises making a hull assembly having an upper surface, the hull assembly including at least one battery, at least one electric drive and at least one steering actuator, making a superstructure assembly on a frame, the superstructure assembly including a controller and user interface, mating the frame and the superstructure assembly to the hull assembly, and connecting a disconnect to allow the controller and user interface to monitor the at least one battery and operate the at least one electric drive and at least one steering actuator.

These and other objects, aspects and advantages of the present invention will be better appreciated in view of the drawings and following detailed description of preferred embodiments.

DETAILED DESCRIPTION OF PREFERRED EMBODIMENTS

Figure 1:
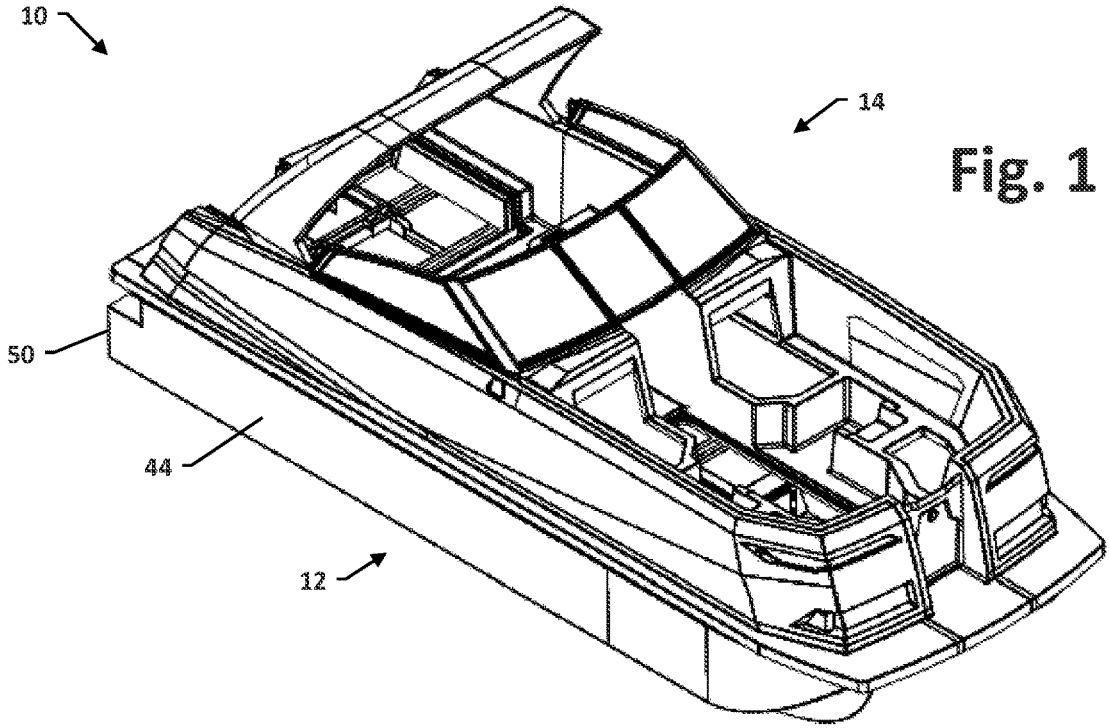
FIG. 1 is perspective view of an electric boat with modular construction including a hull assembly and a superstructure assembly, according to an embodiment of the present invention.
Figure 2:
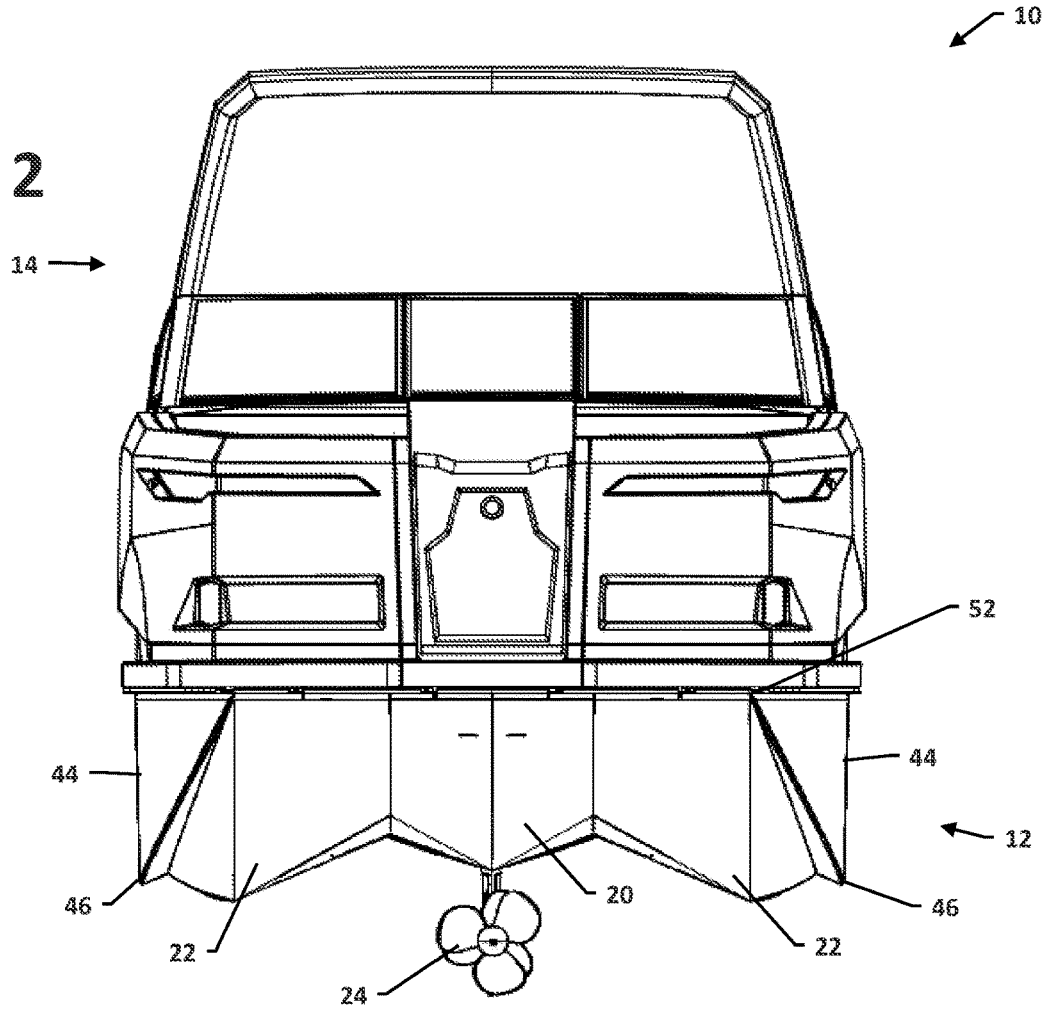
FIG. 2 is a front view of the electric boat of FIG. 1.
Figure 3:
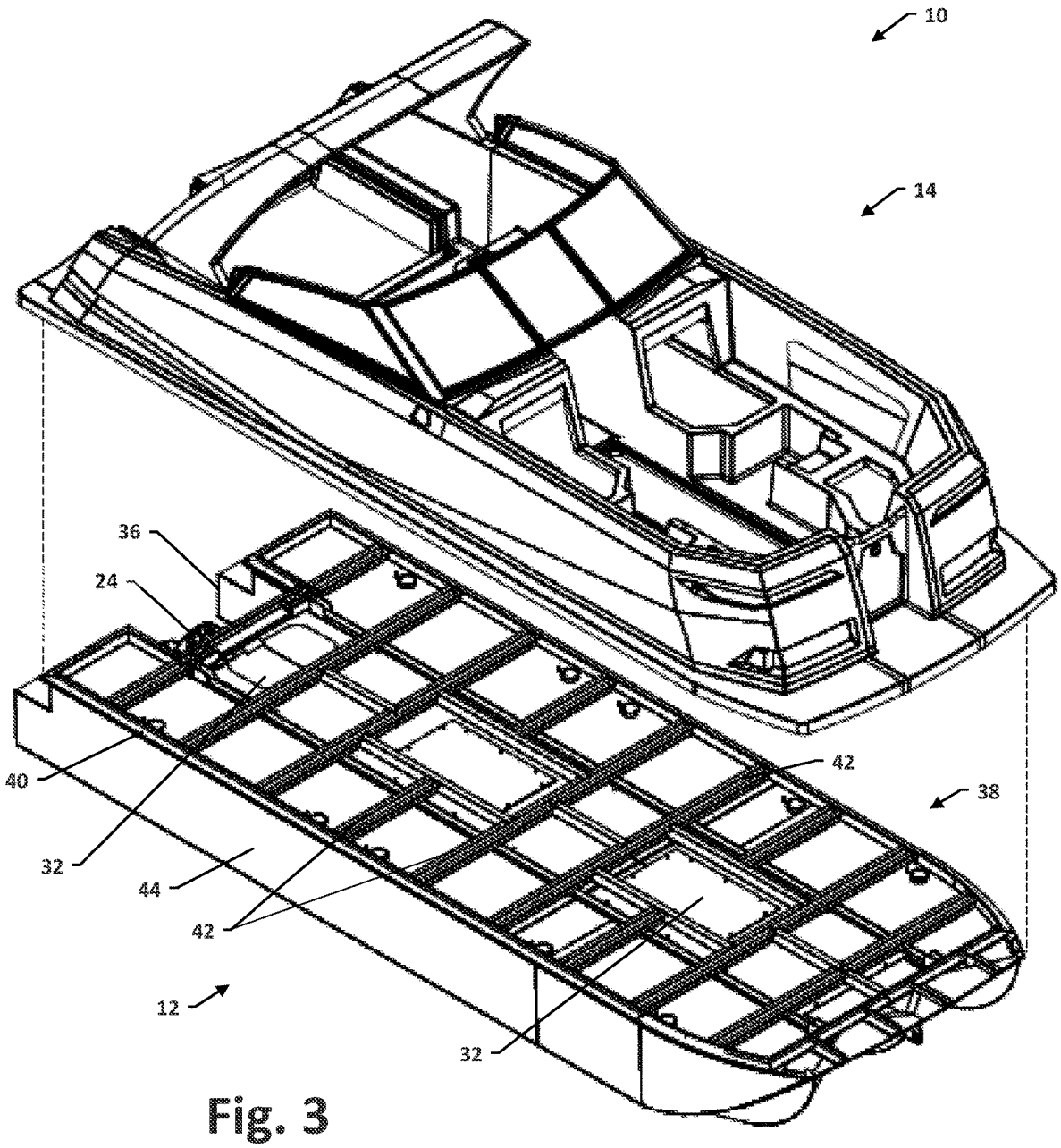
FIG. 3 is a partially exploded perspective view of the electric boat of FIG. 1.

According to an embodiment of the present invention, referring to FIGS. 1-3, an electric boat 10 includes a hull assembly 12 mated to a superstructure assembly 14 at a plurality of discrete mounting points, allowing a given hull assembly 12 to be readily used with any one of a plurality of different superstructure assemblies.

Figure 4:
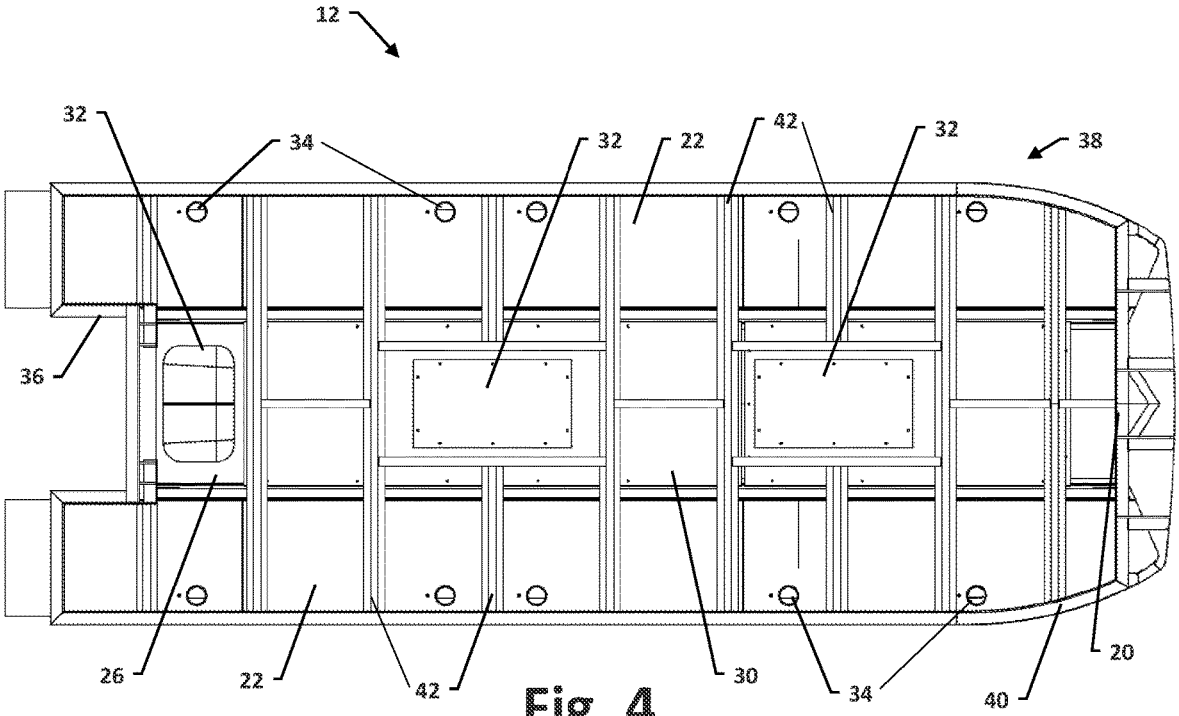
FIG. 4 is a top view of the hull assembly of FIG. 1.
Figure 5:
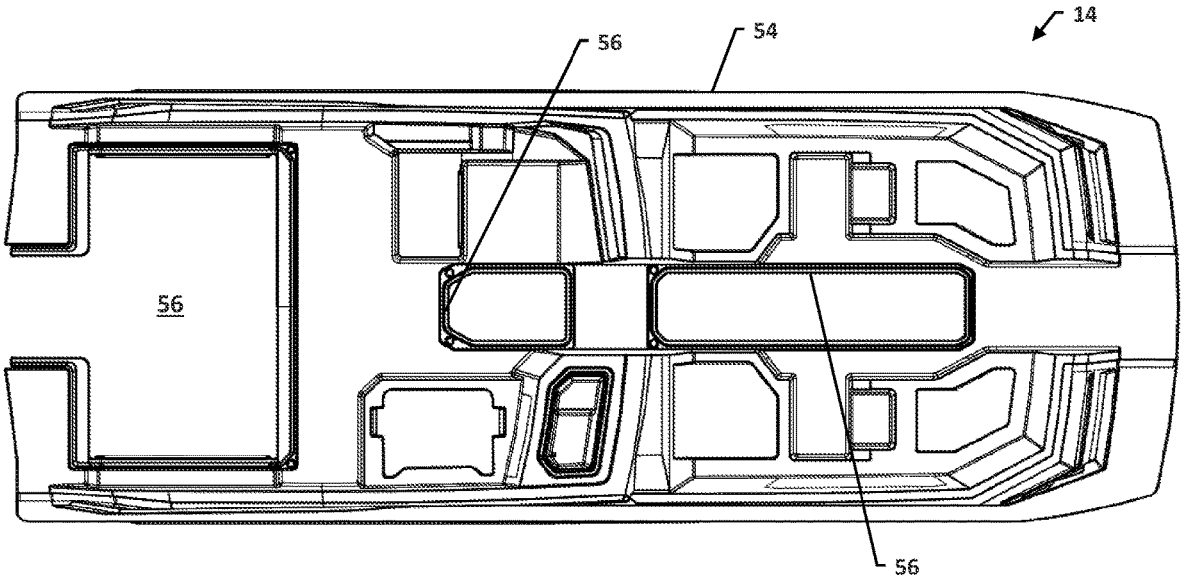
FIG. 5 is a bottom view of the superstructure assembly of FIG. 1.

Referring also to FIG. 4, the hull assembly 12 includes a central section 20 and outboard sections 22. The central section 20 contains the drive 24 (see FIGS. 2 and 3), such as the depicted forward drive, mounted to the aft end thereof. The interior of the central section 20 is divided into a motor compartment 26 housing the electric motor for, and adjacent to, the drive 24, and a battery compartment 30 housing the batteries. Access openings 32 are provided over the compartments 26, 30 allowing access as needed for inspection and maintenance. The central and outboard sections 20, 22 can be fabricated from aluminum for durability. The metal construction can also aid in active and/or passive thermal management of battery heat.

The outboard sections 22 are each preferably completely sealed, resulting in constant buoyancy and requiring no interior maintenance, similar to pontoons. Advantageously, each outboard section 22 is subdivided into separate watertight compartments, with inspection ports 34 allowing visualization of the separate compartments. Each outboard section 22 preferably extends aft of the central section 20, creating a recessed area 36 in which the drive 24 is mounted.

A frame 38 including perimeter framing 40 and a plurality of lateral members 42 extends across the tops of the central and outboard sections 22. Preferably, the superstructure assembly 14 is assembled on the frame 38 and then the combined superstructure assembly 14 and frame 38 are mated to the hull assembly 12 at discrete points around the perimeter framing, improving overall lateral stiffness at the interface between hull and superstructure assemblies 12, 14. The lateral members 42 are arranged, and shortened as necessary, to ensure the access openings 32 are not impeded.

To maximize available space and design flexibility for the superstructure assembly 14, the upper surface of the hull assembly 12 is nearly rectangular. In particular, a total mated area of the hull and superstructure assemblies deviates from a rectangle over less than 25% an area thereof, and more preferably, less than 10%. In other words, the total mated area is within 25% (or within 10%) of the area of a rectangle most closely engaging a perimeter of the mated area. To facilitate mating the frame 38 and superstructure assembly 14 to the hull assembly 12, the upper surface of the hully assembly 12 is preferably flat.

For enhanced stability outer sidewalls 44 of the outboard sections 22 are close to vertical. To facilitate maintenance of this geometry while decreasing wetted surface area to improve planing performance and minimizing side splash, lower edges of the sidewalls 44 are formed by respective chines 46 extending along the entire length of the respective outboard sections 22 from the transom 50 to each prow 52 (i.e., the uppermost part of the bow of each outboard section 22). In particular, the sidewalls deviate less than 5 degrees from vertical down to the chines 46, and more preferably, less than 3 degrees from vertical, over a majority (and more preferably over at least ⅔ or even over at least 80%) of their length. The bottom of the central section 20 is also raised higher than the bottoms of the outboard sections, thereby reducing wetted surface while planing and affording stability characteristics similar to a catamaran hull or pontoon boat.

The superstructure assembly 14 has a perimeter 54 preferably closely matched in shape to the perimeter framing 40. Additionally, openings 56 are defined to overlie the openings 32, affording axis for inspection and maintenance without the need to de-mate the entire superstructure assembly 14. Suitable covers are preferably removably attached to close the openings 32 during normal use of the boat 10. It will be appreciated that, within the perimeter 54 and around the openings 32, the configuration of the superstructure assembly 14 is readily adaptable to meet a given set of functional requirements and/or aesthetic preferences.

Figure 6:
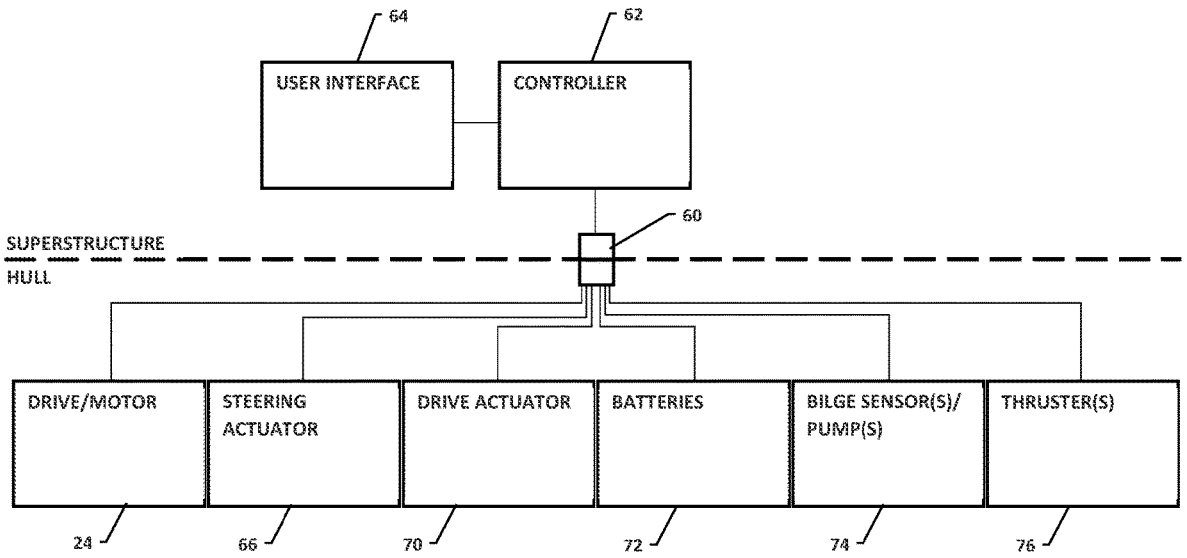
FIG. 6 is a schematic overview of electrical and control components of the electric boat of FIG. 1.

Referring to FIG. 6, advantageously a single disconnect 60 allows quicky making and unmaking of all necessary power, data and control connections between the hull assembly 12 components and a controller 62 and user interface 64 carried by the superstructure assembly 14 of the electric boat 10. Besides, the electric drive 24 actuators 66, 70 for drive steering and trim, the batteries 72 and any bilge sensors and pumps 74, the hull assembly 12 could also mount bow and/or stern thrusters 76 operable via the controller 62 and user interface 64.

Advantageously, any such thrusters are configured to run on the higher direct current (DC) voltages (e.g., 400 volts DC) supplied by the batteries 72 to the electric drive 24. Consequently, thruster operation is more efficient than with conventional low voltage thrusters (e.g., 12-24 volts DC) and, due to the lower current demand, results in less heat generation during prolonged operation.

Figure 7:
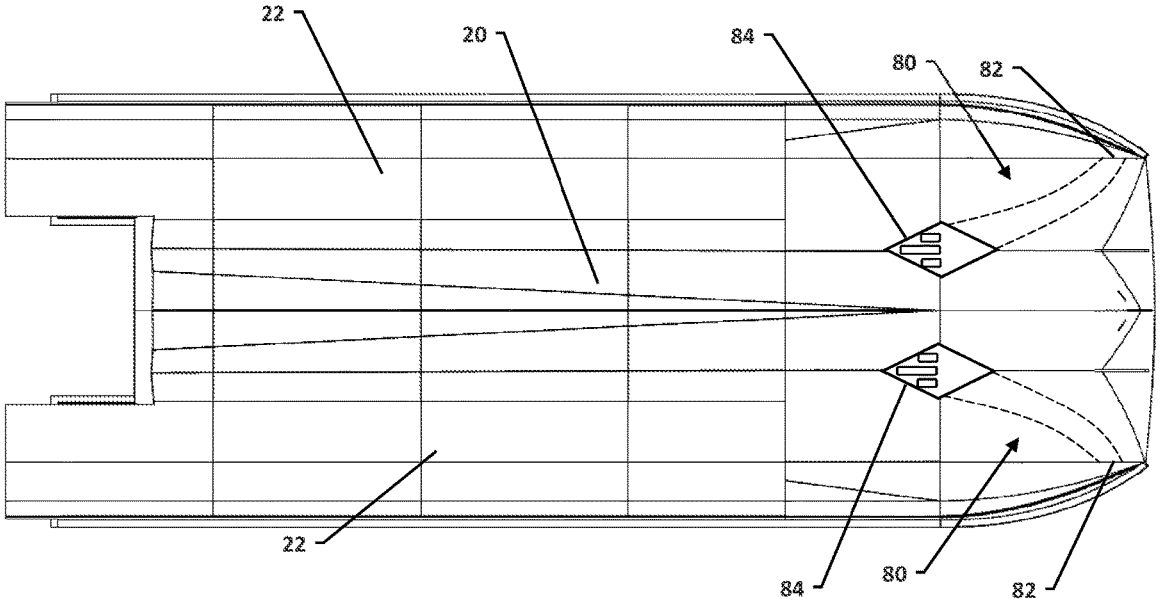
FIG. 7 is a bottom view of an alternate embodiment of the hull assembly of FIG. 1, including splash reduction channels with broken lines indicating internal structure.
Figure 8:
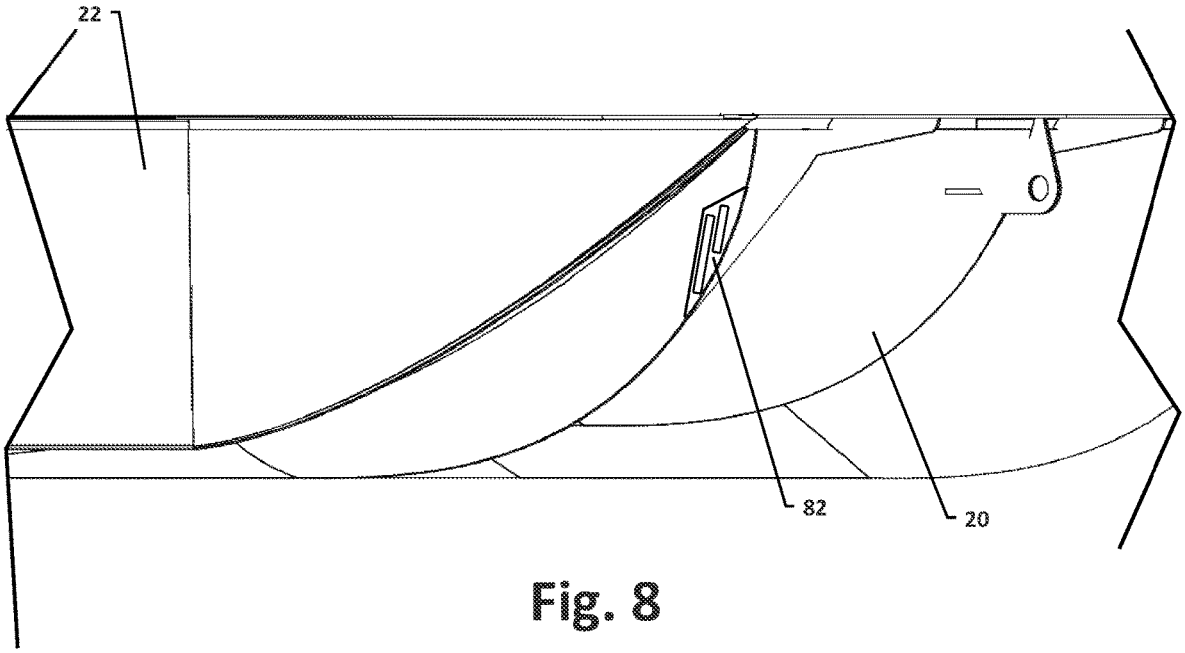
FIG. 8 is a partial perspective view including a forward end of a representative one of the splash reduction channels.

Referring to FIGS. 7 and 8, bow splash can be minimized for the hull assembly via splash reduction channels 80. Each splash reduction channel 80 extends between a first end opening 82 on an outboard side of the bow of a respective one of the outboard sections 22 and a second end opening 84 in apex of the junction between the respective outboard section 22 and the central section 20. Each second end opening 84 is aft of the first end opening 80 and preferably proximate to the transition from the bow to the bottom of the outboard sections 22. Under certain sea conditions, as the bows drop down after a rise, water—that might otherwise be channeled forwardly between the center and outboard sections 20, 22 and cause additional bow spray—is forced into the second end openings 84 and redirected outwardly via the channels 80 and laterally out the first end openings 82. Combined with the effect of the chines 46, the channels 80 allow for a drier ride in a wider range of sea conditions. Such hull features could be advantageously incorporated into other hulls not used in connection with modular construction and/or electric drives.

The above-described embodiments are provided for illustrative purposes; the present invention is not necessarily limited thereto. Rather, those skilled in the art will appreciate that various modifications, as well as adaptations to particular circumstances, will fall within the scope of the invention herein shown and described and of the claims appended hereto.

What is claimed is:

1. A modular boat comprising:

a hull assembly including a battery compartment;

a superstructure assembly mated to the hull assembly at a plurality of discrete mounting points;

at least one electric drive mounted to the hull assembly;

at least one steering actuator mounted to the hull assembly;

at least one battery located in the battery compartment and connected to power the at least one electric drive;

at least one electric thruster powered by the at least one battery at a common direct current (DC) voltage with the at least one electric drive;

a controller and user interface carried by the superstructure and operable to control the at least one electric drive and the at least one steering actuator, and to provide battery information about the at least one battery; and a disconnect between the hull assembly and superstructure assembly effecting making and unmaking all connections between superstructure and the at least one electric drive, at least one steering assembly and at least one battery of the hull assembly.

2. The modular boat assembly of claim 1, wherein the hull assembly further includes a motor compartment housing an electric motor of the drive.

3. The modular boat assembly of claim 2, wherein the electric drive includes a forward drive mounted to a stern of the hull assembly and connected to the electric motor in the motor compartment.

4. The modular boat assembly of claim 1, wherein aligned access openings are formed over the battery compartment in the hull and superstructure assemblies, allowing access thereinto while the hull and superstructure assemblies are mated.

5. The modular boat assembly of claim 4, wherein the hull assembly includes a central section containing the battery compartment and outboard sections on opposite sides of the central section, the outboard sections being completely sealed.

6. The modular boat assembly of claim 1, wherein the disconnect also effects making and unmaking of connections for the at least one electric thruster.

7. The modular boat assembly of claim 1, further comprising at least one bilge pump;

wherein the disconnect also effects making and unmaking of connections for the at least one bilge pump.

8. The modular boat assembly of claim 1, wherein the hull assembly includes a central section and outboard sections on opposite sides of the central section, bottoms of the outboard sections being lower than a bottom of the central section.

9. The modular boat assembly of claim 8, wherein the central section contains the battery compartment and the outboard sections are completely sealed.

10. The modular boat assembly of claim 8, wherein each outboard section includes a chine extending along a length thereof and forming a transition from a bottom to a sidewall.

11. The modular boat assembly of claim 10, wherein each of the chines extends along an entirety of the length of its outboard section to a prow thereof.

12. The modular boat assembly of claim 10, wherein the sidewalls deviate from vertical by less than 5 degrees over a majority of their length.

13. The modular boat assembly of claim 12, wherein the sidewalls deviate from vertical by less than 3 degrees over a majority of their length.

14. The modular boat assembly of claim 12, wherein the sidewalls deviate from vertical by less than 5 degrees over at least ⅔ of their length.

15. The modular boat assembly of claim 14, wherein the sidewalls deviate from vertical by less than 5 degrees over at least 80% of their length.

16. The modular boat assembly of claim 12, wherein a total mated area deviates from a rectangle over less than 25% thereof.

17. The modular boat assembly of claim 16, wherein the total mated area deviates from a rectangle over less than 10% thereof.

18. The modular boat assembly of claim 8, further comprising a pair of splash reduction channels, each splash reduction channel extending between a first end opening on an outboard side of a bow of a respective one of the outboard sections and a second end opening in an apex of the junction between the respective outboard section and the central section.

19. A method of making a modular boat assembly, the method comprising:

making a hull assembly having an upper surface, the hull assembly including at least one battery, at least one electric drive, at least one steering actuator, and at least one electric thruster;

making a superstructure assembly on a frame, the superstructure assembly including a controller and user interface;

mating the frame and the superstructure assembly to the hull assembly; and connecting a disconnect to allow the controller and user interface to monitor the at least one battery and operate the at least one electric drive, at least one steering actuator, and the at least one electric thruster, wherein the at least one electric thruster is powered at a common direct current (DC) voltage with the at least one electric drive.

20. The method of claim 19, wherein making the hull assembly includes a making a flat upper surface thereof and mating the frame and superstructure assembly to the hull assembly includes connecting the frame to the hull assembly at discrete points around the flat upper surface thereof.

21. The method of claim 19, wherein mating the frame and superstructure assembly to the hull assembly include aligning access openings of the superstructure assembly over access openings of the hull assembly.

22. The method of claim 21, wherein making the hull assembly includes making a central section with outboard sections on opposite sides thereof, the access openings of the hull assembly being located on the central section.

* * * * *